US006543907B2

(12) United States Patent
Nishiyama et al.

(10) Patent No.: US 6,543,907 B2
(45) Date of Patent: Apr. 8, 2003

(54) LASER BEAM EMITTING UNIT

(75) Inventors: Masataka Nishiyama, Saitama (JP); Taminori Odano, Saitama (JP)

(73) Assignee: Pentax Corporation, Tokyo (JP)

( * ) Notice: Subject to any disclaimer, the term of this patent is extended or adjusted under 35 U.S.C. 154(b) by 0 days.

(21) Appl. No.: 09/978,032

(22) Filed: Oct. 17, 2001

(65) Prior Publication Data

US 2002/0048171 A1 Apr. 25, 2002

(30) Foreign Application Priority Data

Oct. 20, 2000 (JP) ..... 2000-321396

(51) Int. Cl.[7] ..... F21V 17/04

(52) U.S. Cl. ..... 362/259; 362/455; 362/555; 359/811

(58) Field of Search ..... 362/259, 268, 362/555, 455, 310; 359/205, 206, 208, 212, 196, 811, 819; 356/329

(56) References Cited

U.S. PATENT DOCUMENTS 4,918,306 A 4/1990 Saito ..... 250/235
5,465,126 A * 11/1995 Fukuda ..... 353/101
5,701,191 A * 12/1997 Iwasaki ..... 359/205
5,768,649 A * 6/1998 Pearson ..... 396/529
5,774,280 A * 6/1998 Miyauchi et al. ..... 359/819
6,208,448 B1 * 3/2001 Shibata ..... 359/196

* cited by examiner

*Primary Examiner*—Sandra O'Shea
*Assistant Examiner*—Ali Alavi
(74) *Attorney, Agent, or Firm*—Greenblum & Bernstein, P.L.C.

(57) ABSTRACT

A laser beam emitting unit includes a laser diode, a collimating lens upon which a laser beam emitted by the laser diode is incident, a base plate to which the laser diode is fixed, a lens holder which holds the collimating lens, and a holder support plate via which the lens holder is fixed to the base plate. The holder support plate includes a flat portion which faces the base plate with a gap between the flat portion and the base plate, and at least two leg portions which extend from the flat portion to the base plate in a direction substantially perpendicular to the flat portion. Each of the at least two leg portions includes a claw portion which is deformed to be fixed to the base plate, wherein the gap is maintained between the flat portion and the base plate.

13 Claims, 8 Drawing Sheets

LASER BEAM EMITTING UNIT

BACKGROUND OF THE INVENTION

1. Field of the Invention

The present invention relates to a laser beam emitting unit which serves as a fundamental component of a scanning optical system incorporated in, e.g., a laser printer.

2. Description of the Related Art

A laser beam emitting unit which serves as a fundamental component of a scanning optical system incorporated in, e.g., a laser printer is known in the art. Such a laser beam emitting unit is provided with a base plate to which a laser diode is fixed, and a lens holder which is fixed to the base plate and holds a collimating lens which collimates a laser beam emitted from the laser diode.

Formerly, the lens holder is fixed to the base plate so that through holes formed on the lens holder and corresponding through holes formed on the base plate are aligned and so that set screws are screwed into these aligned through holes.

According to such a conventional fixing manner, since the relative position between the lens holder and the base plate is determined by bringing the through holes of the lens holder into alignment with the through holes of the base plate, all the through holes must be formed with an extremely high degree of precision. This is a troublesome task. In addition, the necessity of the set screws for fixing the lens holder to the base plate increases assembling costs.

SUMMARY OF THE INVENTION

An object of the present invention is to provide a laser beam emitting unit which is characterized in that the lens holder and the base plate can be fixed to each other while being precisely positioned relative to each other with a high degree of precision and with easy of assembly.

To achieve the object mentioned above, according to an aspect of the present invention, a laser beam emitting unit is provided, including a laser diode, a collimating lens upon which a laser beam emitted by the laser diode is incident, a base plate to which the laser diode is fixed, a lens holder which holds the collimating lens, and a holder support plate via which the lens holder is fixed to the base plate. The holder support plate includes a flat portion which faces the base plate with a gap between the flat portion and the base plate, and at least two leg portions which extend from the flat portion to the base plate in a direction substantially perpendicular to the flat portion. Each of the at least two leg portions includes a claw portion which is deformed to be fixed to the base plate, wherein the gap is maintained between the flat portion and the base plate.

Preferably, the base plate includes at least two receiving portions which receive the at least two leg portions, respectively.

Preferably, the at least two receiving portions include at least two recessed portions in which the at least two leg portions are respectively fitted.

Preferably, each of the at least two leg portions includes an engaging member having a contacting surface which is in contact with the base plate, and a projecting portion which extends from the engaging member to be fitted in corresponding one of the at least two recessed portions, the claw portion being formed on the projecting portion.

Preferably, the base plate has a substantially rectangular shape, the at least two receiving portions including at least one pair of receiving portions respectively formed on opposite sides of the base plate to be opposed to each other.

Preferably, the projecting portion has a substantially U-shape, and includes a projecting base, the claw portion, and a recessed portion formed between the projecting base and the claw portion, and wherein the lens holder is fixed to the base plate by bending the claw portion along a surface of the base plate so that the engaging member and the projecting base hold a portion of the base plate therebetween.

Preferably, the following condition is satisfied:

$Ze<Z_5<Zt$; wherein "$Z_5$" represents a thickness of the base plate; "Zt" represents a distance from a plane including the contacting surface to a first point on a surface of the claw portion in the vicinity of a tip of the claw portion, in the direction substantially perpendicular to the flat portion; and "Ze" represents a distance from the plane to a second point on a surface of the claw portion in the vicinity of the root of the claw portion, in the direction substantially perpendicular to the flat portion.

Preferably, the holder support plate is made of a metal.

Preferably, the projecting base is fitted in corresponding one of the at least two recessed portions with a minimum clearance.

Preferably, the claw portion includes an inclined engaging surface provided on the claw portion opposing the projecting base, the lens holder being fixed to the base plate with the engaging surface in contact with the surface of the base plate.

Preferably, the lens holder is fixed to the holder support plate via at least two set screws, a through hole being formed on the base plate so that a screw driver is accessible to one of the at least two set screws through the through hole.

According to another aspect of the present invention, a laser beam emitting unit is provided, including a laser diode, a collimating lens upon which a laser beam emitted by the laser diode is incident, a base plate to which the laser diode is fixed, and a holder support plate which is fixed to the base plate and supports the collimating lens. The base plate includes at least two recessed portions which define a fixing position of the holder support plate relative to the base plate. The holder support plate includes a flat portion which faces a front surface of the base plate with a gap between the flat portion and the base plate, and at least two leg portions which extend from the flat portion to the base plate in a direction substantially perpendicular to the flat portion to be associated with the at least two recessed portions. Each of the at least two leg portions includes an engaging member which is in contact with the front surface of the base plate, and a projecting portion which extends from the engaging member to be fitted in corresponding one of the at least two recessed portions, a claw portion being formed on the projecting portion, the claw portion being deformed to be fixed to a rear surface of the base plate with the gap being maintained between the flat portion and the base plate.

According to another aspect of the present invention, a laser beam emitting unit is provided, including a base plate to which a laser diode is fixed, a lens holder which holds a collimating lens through which a laser beam emitted by the laser diode is collimated, and a holder support plate positioned between the base plate and the lens holder to fix the lens holder to the base plate via the holder support plate. The holder support plate includes a flat portion which faces the base plate with a gap between the flat portion and the base plate, and a pair of leg portions which extend from the flat portion in a direction substantially perpendicular to the flat portion to be engaged with the base plate. Each of the pair of two leg portions includes a claw portion which is deformed to be fixed to the base plate.

The present disclosure relates to subject matter contained in Japanese Patent Application No.2000-321396 (filed on Oct. 20, 2000) which is expressly incorporated herein by reference in its entirety.

BRIEF DESCRIPTION OF THE DRAWINGS

The present invention will be described below in detail with reference to the accompanying drawings in which.

DESCRIPTION OF THE PREFERRED EMBODIMENT

Figure 1:
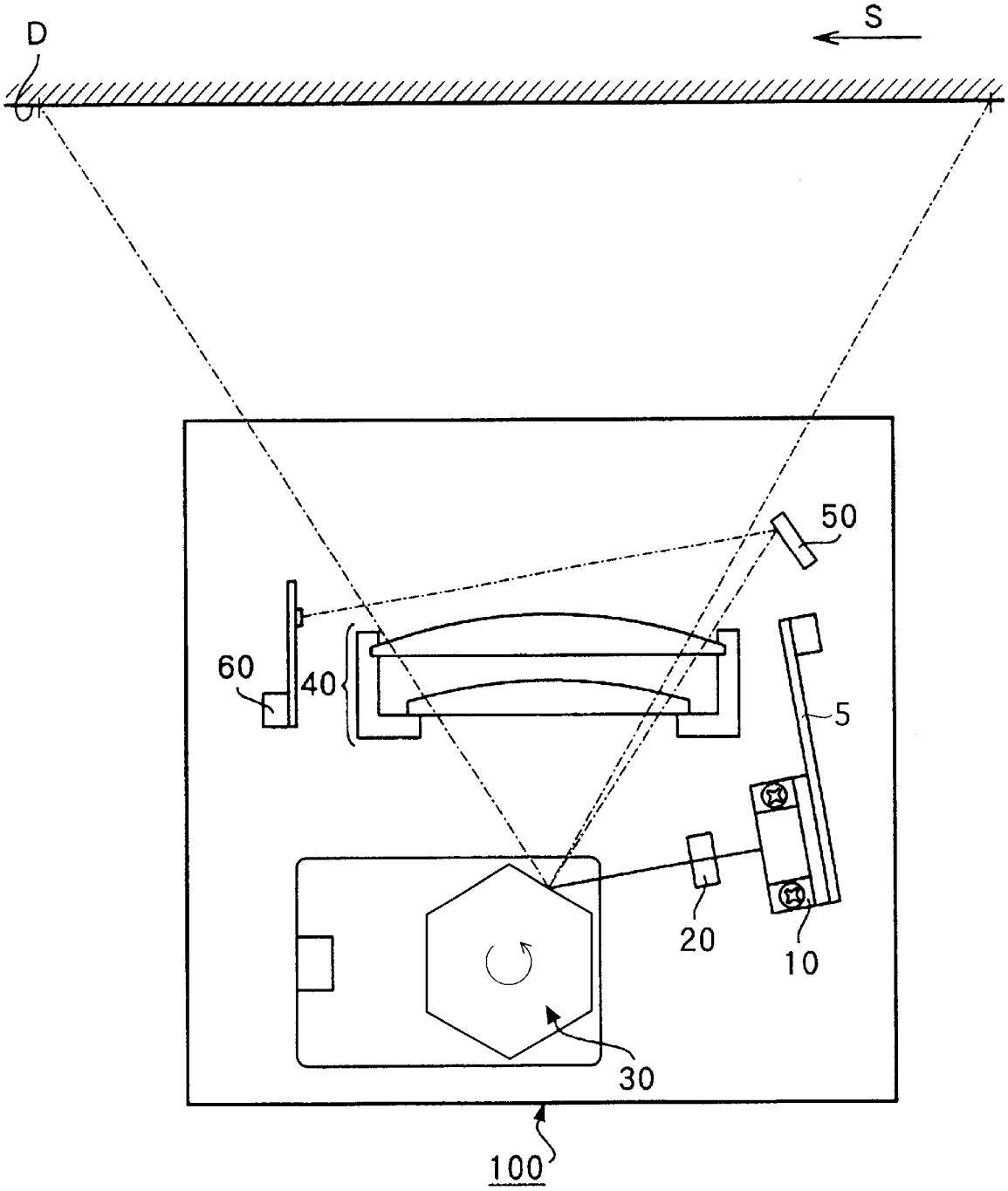
FIG. 1 is a schematic plan view of a scanning optical system incorporated in a laser printer which is provided with an embodiment of a laser beam emitting unit according to the present invention.
Figure 2:
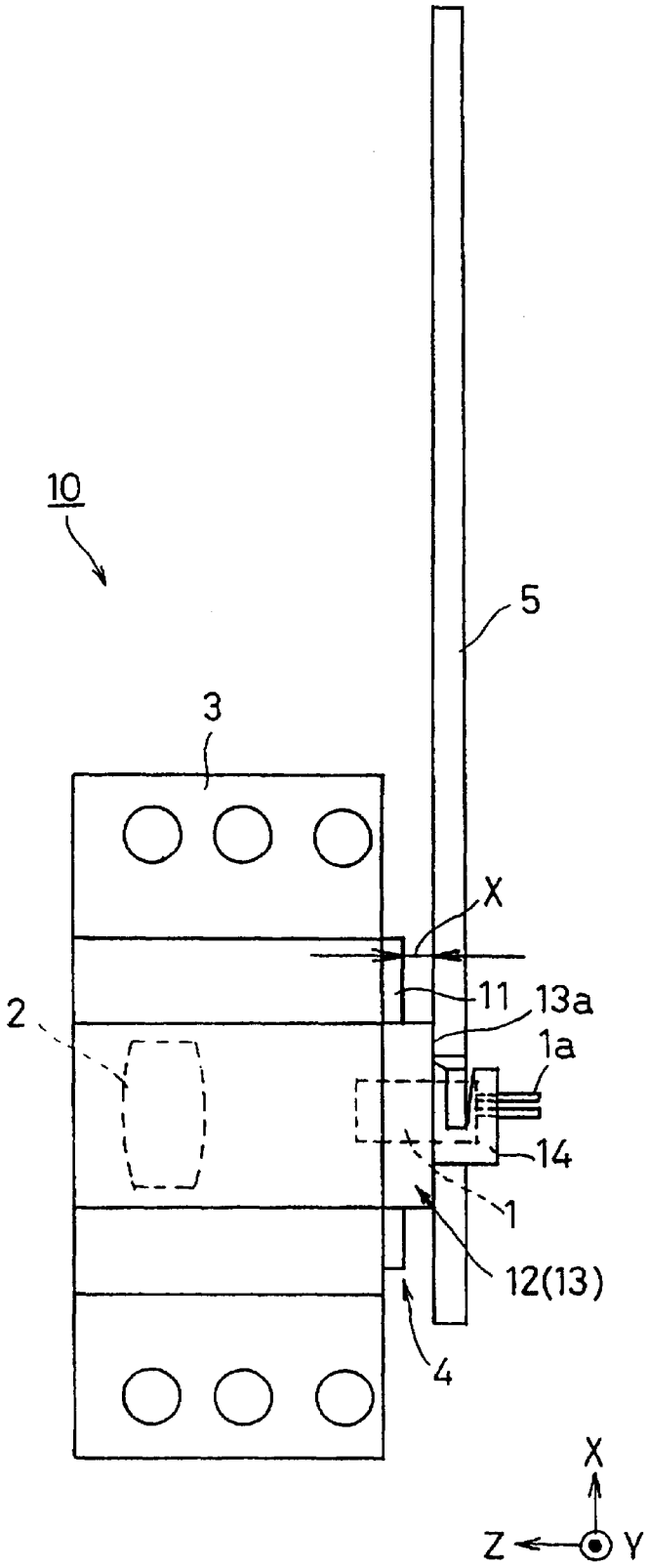
FIG. 2 is a side elevational view of the laser beam emitting unit shown in FIG. 1.

FIG. 1 shows a scanning optical system 100 having an embodiment of a laser beam emitting unit 10 according to the present invention. The scanning optical system 100 is incorporated in a laser printer. The scanning optical system 100 is provided with a cylindrical lens 20, a rotary polygon mirror (light-beam deflector) 30, an fθ lens group 40, a reflecting mirror 50, and a laser-beam detector (photodetector) 60, in that order in an optical path of the scanning optical system 100 from the laser beam emitting unit 10 side.

A collimated laser beam emitted from the laser beam emitting unit 10 is incident on the polygon mirror 30 after passing through the cylindrical lens 20. The polygon mirror 30 is driven to rotate at a constant rotational speed by a motor (not shown), so that the laser beam incident on the polygon mirror 30 is deflected in the main scanning direction to scan a surface (photoconductive surface) of a photoconductive drum D in the main scanning direction (the horizontal direction shown by an arrow S in FIG. 1) via the fθ lens group 40. The laser beam deflected by the polygon mirror 30 is initially incident on the reflecting mirror 50, before being incident on the photoconductive drum D, to be received by the laser-beam detector 60. The scanning starting point of a spot of the scanning laser beam on the photoconductive surface of the drum D is controlled by a controller (not shown) in accordance with the detection of the scanning laser beam with the laser-beam detector 30.

Figure 8:
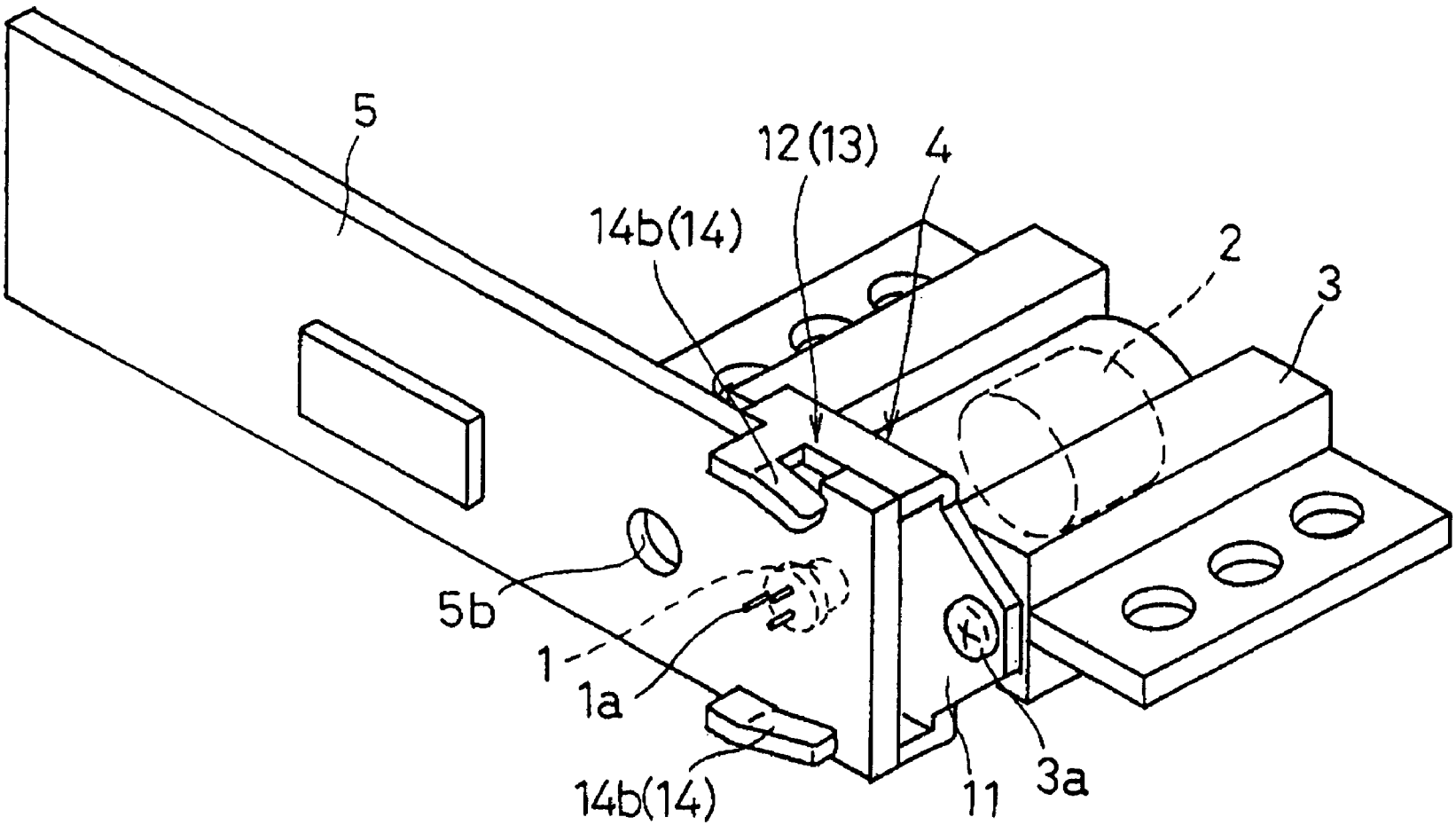
FIG. 8 is a perspective view of the laser beam emitting unit in a state after the holder support plate has been fixed to the base plate.
Figure 9:
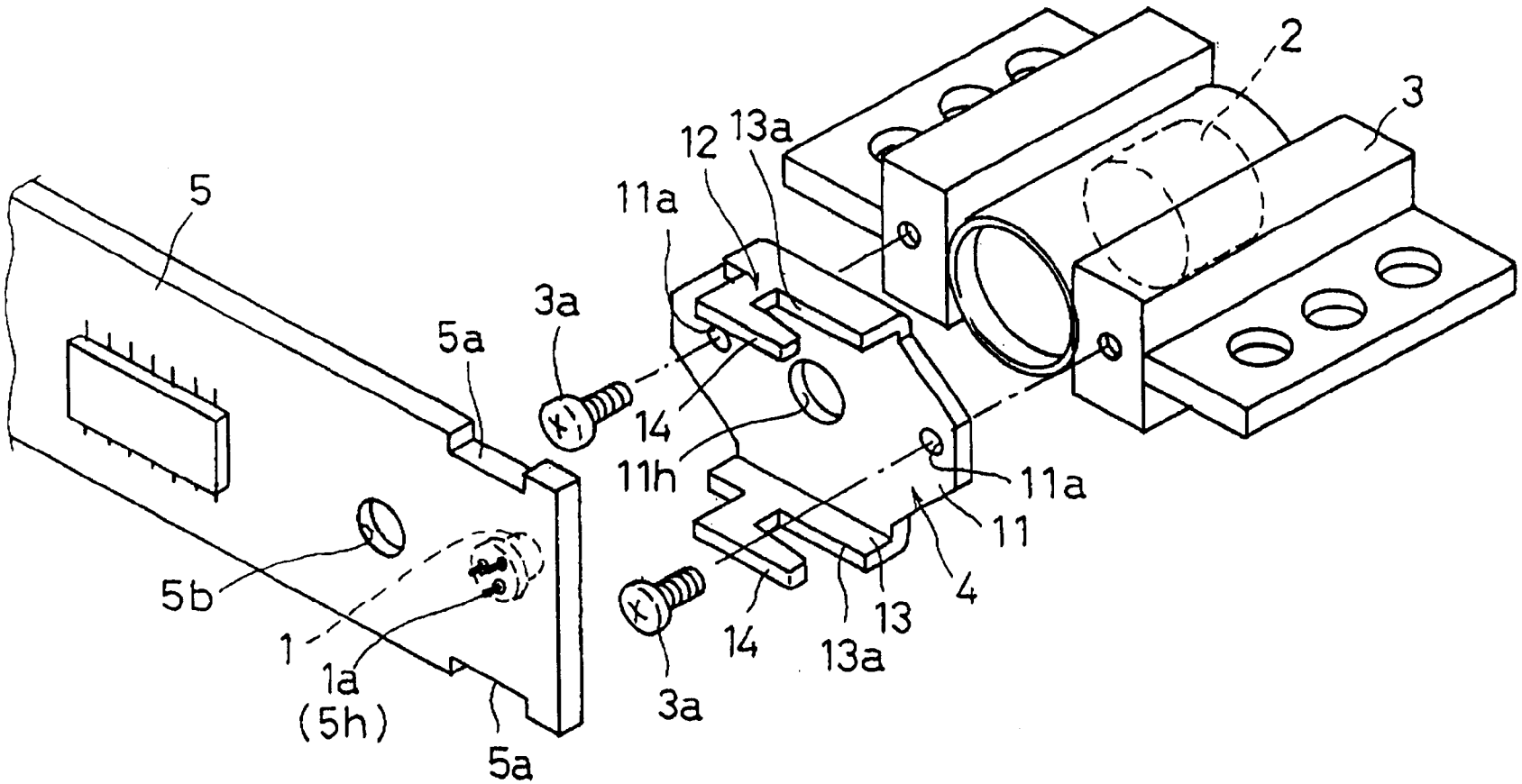
FIG. 9 is an exploded perspective view of the laser beam emitting unit, showing a state before the holder support plate is fixed to the base plate.

As shown in FIGS. 2, 8, 9 and 10, the laser beam emitting unit 10 is provided with a laser diode (LD) 1, a collimating lens 2, a lens holder 3, a holder support plate 4 and a base plate 5. The laser diode 1 is provided with three legs la (see FIG. 8) which are respectively inserted into three through holes 5*h* (see FIG. 3) formed on the base plate 5. The three legs 1*a* respectively inserted into the three through holes 5*h* are soldered to the base plate 5 to fix the laser diode 1 to the base plate 5. As shown in FIG. 9, the lens holder 3 that holds the collimating lens 2 is fixed to the holder support plate 4 by two set screws 3*a* to be integral with the holder support plate 4. The structures of the collimating lens 2 and the lens holder 3 are not limited solely to the particular structures shown in the drawings.

Figure 3:
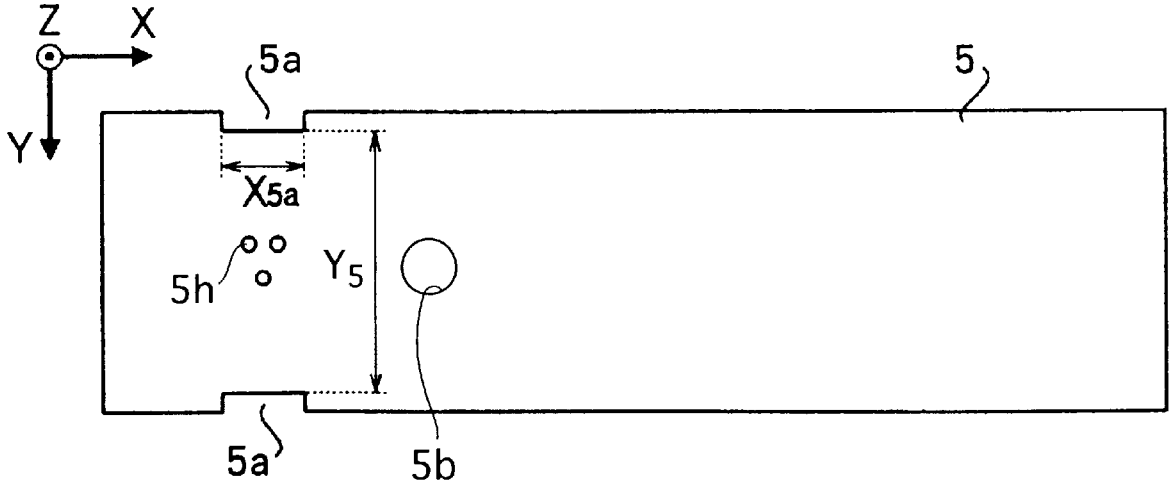
FIG. 3 is a schematic plan view of a base plate of said laser beam emitting unit.

As shown in FIG. 3, the base plate 5 has a substantially rectangular shape. The lateral direction (the horizontal direction as viewed in FIG. 3) of the base plate 5, the longitudinal direction (the vertical direction as viewed in FIG. 3) of the base plate 5, and the direction normal to both the lateral and longitudinal directions (i.e., the direction normal to the drawing surface of FIG. 3) are herein defined as X-direction, Y-direction and Z-direction, respectively. The Z-direction corresponds to the direction of the optical axis of the collimating lens 2. The base plate 5 is provided, on the opposite sides thereof in the vicinity of one end (the left end as viewed in FIG. 3) of the base plate 5, with a pair of recessed portions 5*a* which have the same shape and size. The pair of recessed portions 5*a* are formed on the base plate 5 on the opposite sides thereof to be opposed to each other. The positions of the pair of recessed portions 5*a* define the fixing position of the holder support plate 4 and the lens holder 3 relative to the base plate 5.

Figure 4:
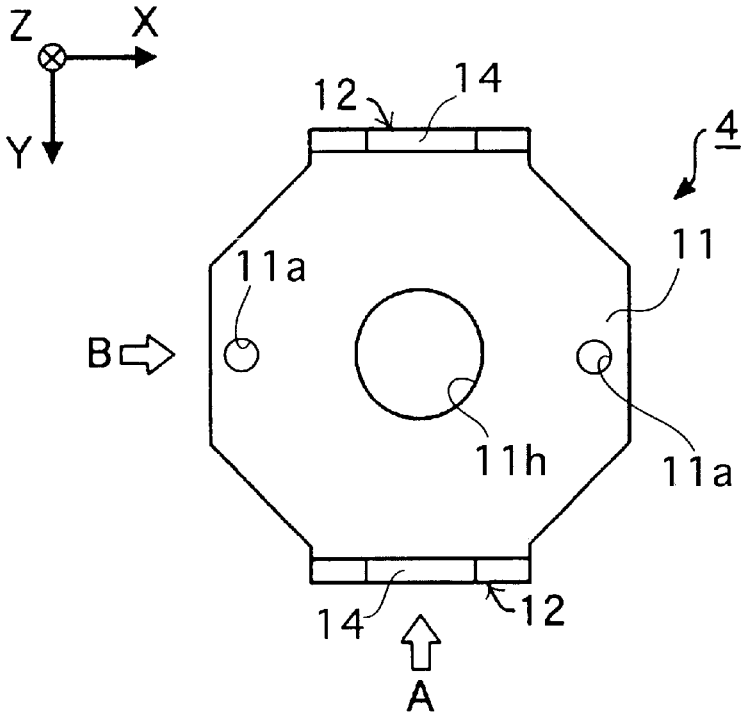
FIG. 4 is a top plan view of a holder support plate of the laser beam emitting unit shown in FIG. 1.
Figure 5:
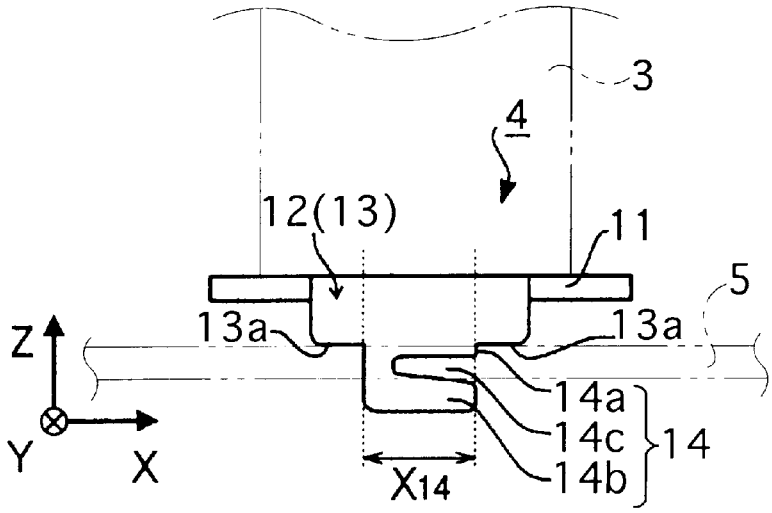
FIG. 5 is a side elevational view of the holder support plate shown in FIG. 4.
Figure 6:
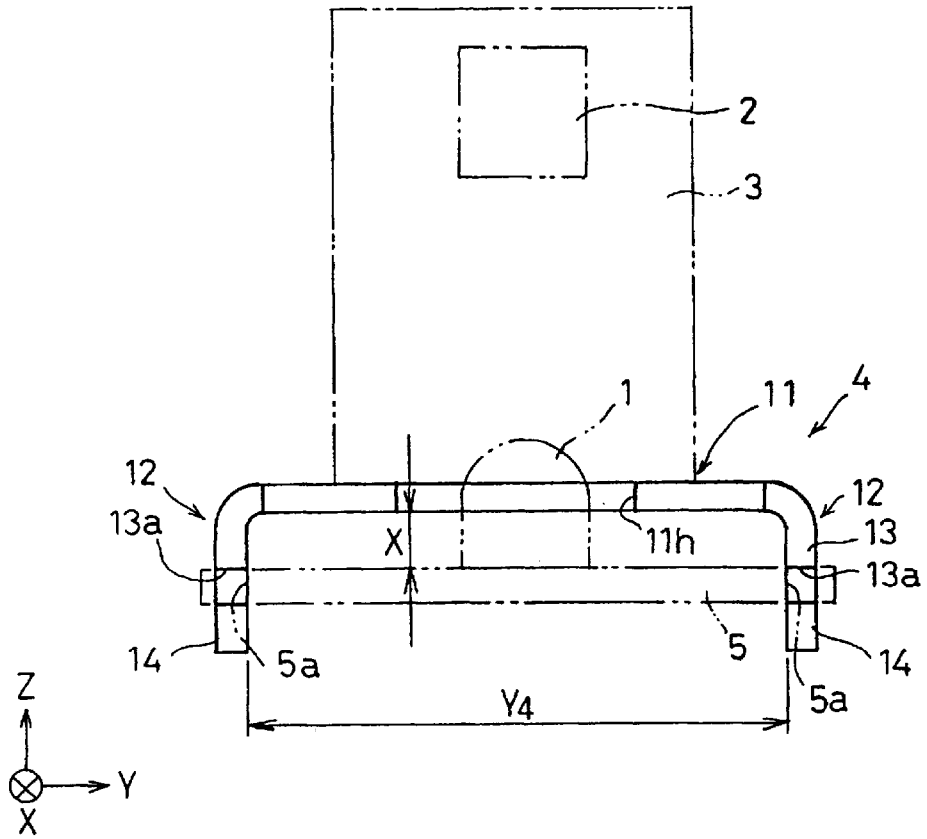
FIG. 6 is a side elevational view of the holder support plate shown in FIG. 4.
Figure 10:
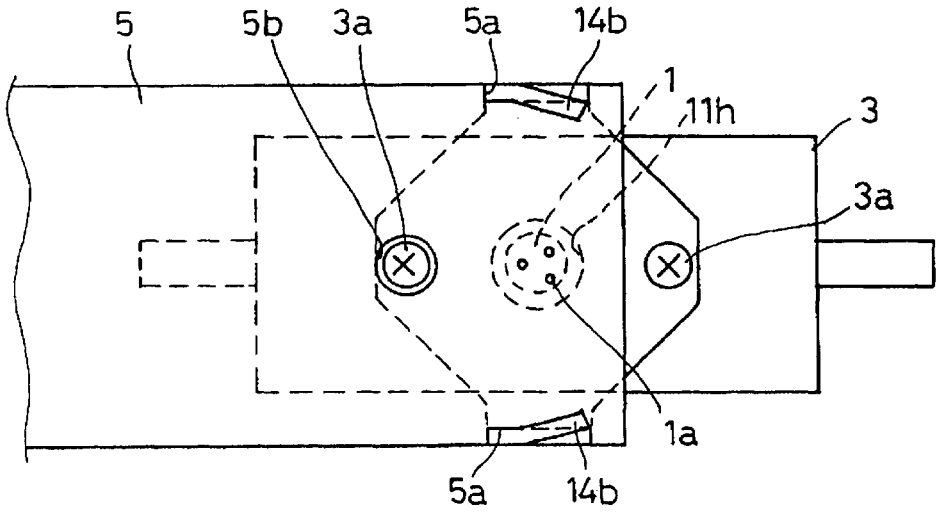
FIG. 10 is a plan view of the laser beam emitting unit shown in FIG. 8.

FIGS. 4 through 6 show the shape of the holder support plate 4. As shown in FIGS. 4 through 6, the holder support plate 4 is made of a single plate, and is provided with a flat portion 11 having a substantially octagonal shape, and a pair of leg portions 12. The flat portion 11 is provided at the center thereof with a circular through hole 11*h* in which a head portion of the laser diode 1 is fitted. The flat portion 11 is provided on opposite sides of the circular through hole 11*h* with two through holes 11*a* in which two set screws 3*a* are inserted, respectively. The pair of leg portions 12 are formed on the holder support plate 4 in a manner such that each of opposite end portions (upper and lower end portions as viewed in FIG. 4) of the flat portion 11 is bent by approximately 90 degrees in a direction opposite to the surface of the flat portion 11 to which the lens holder 3 is mounted (see FIGS. 6 and 9). The holder support plate 4 is made of a metal such as an aluminum alloy to efficiently dissipate heat generated by the laser diode Each of the pair of leg portions 12 is provided with a spacer portion 13 which extends substantially perpendicular to the flat portion 11, and a projecting portion 14 which extends from the spacer portion 13 from a substantially center thereof. Each spacer portion 13 extends parallel the X-direction, and is provided with a contacting surface 13*a* which is positioned apart from the flat portion 11 of the holder support plate 4 in the Z-direction by a predetermined distance. Each projecting portion 14 has a substantially U-shape, and is provided with a projecting base 14*a*, a claw portion 14*b* and a recessed portion 14*c* formed between the projecting base 14*a* and the claw portion 14*b*. The projecting base 14*a* is fitted in the corresponding one of the pair of recessed portions 5*a* with a minimum clearance.

Figure 7:
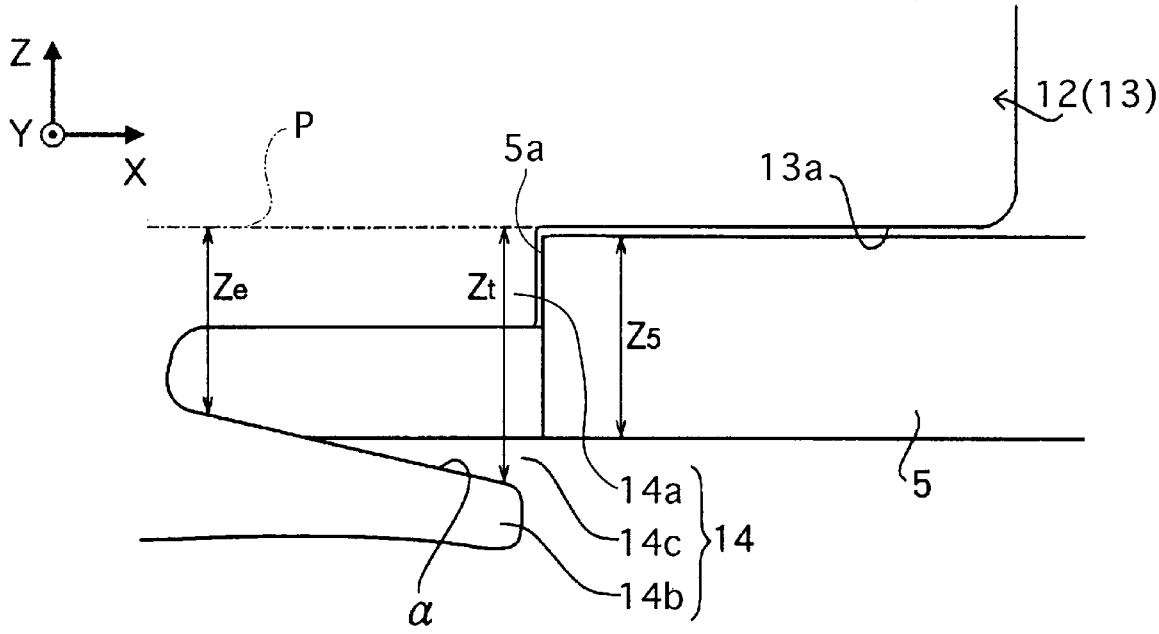
FIG. 7 is an enlarged side elevational view of a fundamental portion of the holder support plate and an associated fundamental portion of the base plate.

FIG. 7 shows one of the two leg portions 12, the projecting portion 14 of which is fitted in the corresponding recessed portion 5*a* of the base plate 5. As shown in FIG. 7, an engaging surface (upper surface as viewed in FIG. 7) of the claw portion 14*b* between the projecting base 14*a* and the claw portion 14*b* is formed as an inclined surface α which is inclined to the X-direction. Accordingly, the following condition is satisfied:

$$Ze<Z_5<Zt$$

wherein "$Z_5$" represents the thickness of the base plate 5,

"Zt" represents the distance from a plane P (shown by one-dot chain line in FIG. 7) including the contacting surface 13*a* of the spacer portion 13 to a point on the inclined surface a in the vicinity of the tip of the claw portion 14*b* in the Z-direction; and "Ze" represents the distance from the plane P to a point on the inclined surface a in the vicinity of the root of the claw portion 14*b* in the Z-direction.

The width $X_{5a}$ (see FIG. 3) of each recessed portion 5*a* in the X-direction corresponds to the width $X_{14}$ (see FIG. 5) of each projecting portion 14 in the X-direction, while the space $Y_5$ (see FIG. 3) between the pair of recessed portions 5*a* corresponds to the space $Y_4$ (see FIG. 6) between the pair of leg portions 12, so that the two projecting bases 14*a* of the two projecting portions 14 are respectively fitted in the two recessed portions 5*a* with a minimum clearance. In this state, a gap (space) X is formed between the flat portion 11 of the holder support plate 4 and the base plate 5 (see FIGS. 2 and 6).

The holder support plate 4 and the base plate 5 are fixed to each other, and the relative position therebetween is determined in such a manner in the following descriptions.

Firstly, the two projecting bases 14*a* of the two projecting portions 14 are respectively fitted in the two recessed portions 5*a* of the base plate 5 to bring the contacting surface 13*a* into contact with a surface of the base plate 5. This determines the position of the lens holder 3 relative to the base plate 5 in the X-direction via the spacer portion 13 and the projecting portion 14. At the same time, the position of the lens holder 3 relative to the base plate 5 in the Z-direction is determined by the contact of the contacting surface 13*a* with a surface of the base plate 5 since each spacer portion 13 extends parallel the X-direction.

In a state where the contacting surface 13*a* is in contact with the base plate 5, the aforementioned gap X (see FIGS. 2 and 6) is formed between the base plate 5 and the flat portion 11. With this structure, one or more parts can be disposed in the gap X and the base plate 5 can be made smaller, while the heat generated by the laser diode 1 can be dissipated efficiently via the gap X.

In a state where the pair of leg portions 12 are respectively inserted into the pair of recessed portions 5*a*, bending each of the two claw portions 14*b* inwardly, toward the three through holes 5*h*, in the Y-direction along a surface of the base plate 5 causes the inclined surface α of each claw portion 14*b* to come into firm contact with the base plate 5, so that each claw portion 14*b* and the corresponding projecting base 14*a* hold a portion of the base plate 5 therebetween in the vicinity of the associated recessed portion 5*a*. Namely, bending each of the two claw portions 14*b* inwardly causes the holder support plate 4 to be fixed to the base plate 5 firmly. FIG. 8 shows such a state after the holder support plate 4 has been firmly fixed to the base plate 5 with the two claw portions 14*b* bent inwardly. The base plate 5 is provided with a through hole 5*b* through which a screw driver is accessible to one of the set screws 3*a* (the left set screw 3*a* as viewed in FIG. 10). The lens holder 3 that holds the collimating lens 2 is fixed to the holder support plate 4 via the two set screws 3*a* to be integral therewith as described above, so that the lens holder 3 can be freely mounted to and dismounted from the holder support plate 4 either before or after the holder support plate 4 is fixed to the base plate 5.

Although the flat portion 11 of the holder support plate 4 has a substantially octagonal shape in the above described embodiment of the laser beam emitting unit 10, the shape of the flat portion 11 is not limited solely to a particular shape.

Although the holder support plate 4 is made of a single metal plate as described above, the holder support plate 4 is not limited solely to such particular material or plate. For instance, the flat portion 11 can be made of a single metal plate while two metal plates which respectively constitute the pair of leg portions 12 can be welded to the flat portion 11.

Although the holder support plate 4 is fixed to the base plate 5 at two points via the two set screws 3*a*, the holder support plate 4 can be fixed to the base plate 5 at more than two points if it is desired to fix the holder support plate 4 to the base plate 5 more firmly.

Although the base plate 5 has a substantially rectangular shape in the above described embodiment of the laser beam emitting unit 10, the shape of the base plate 5 is not limited solely to a particular shape. Although each of the pair of recessed portions 5*a* is formed by cutting out a part of the base plate 5 in the above described embodiment of the laser beam emitting unit 10, each of the pair of recessed portions 5*a* can be formed by forming projecting portions on an edge of base plate 5 at predetermined intervals. The pair of recessed portions 5*a* can be replaced by a pair of through slots formed on the base plate 5 into which the pair of projecting portions 14 can be inserted.

As can be understood from the above descriptions, according to a laser beam emitting unit to which the present invention is applied, since the holder support plate includes a flat portion (11) which faces the base plate with a gap (X) between the flat portion and the base plate, and at least two leg portions (12) which extend from the flat portion to the base plate in a direction substantially perpendicular to the flat portion, and each of the two leg portions includes a claw portion (14*b*) which is deformed to be fixed to the base plate with the gap being maintained between the flat portion and the base plate, the holder and the base plate can be fixed to each other while being precisely positioned relative to each other with a high degree of precision and with ease of assembly.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A laser beam emitting unit comprising:

a laser diode;

a collimating lens upon which a laser beam emitted by said laser diode is incident;

a base plate to which said laser diode is fixed;

a lens holder which holds said collimating lens; and a holder support plate via which said lens holder is fixed to said base plate;

wherein said holder support plate includes a flat portion which faces said base plate with a gap between said flat portion and said base plate, and at least two leg portions which extend from said flat portion to said base plate in a direction substantially perpendicular to said flat portion; and wherein each of said at least two leg portions includes a claw portion which is deformed to be fixed to said base plate, wherein said gap is maintained between said flat portion and said base plate.

2. The laser beam emitting unit according to claim 1, wherein said base plate comprises at least two receiving portions which receive said at least two leg portions, respectively.

3. The laser beam emitting unit according to claim 2, wherein said at least two receiving portions comprise at least two recessed portions in which said at least two leg portions are respectively fitted.

4. The laser beam emitting unit according to claim 3, wherein each of said at least two leg portions comprises:

an engaging member having a contacting surface which is in contact with said base plate; and a projecting portion which extends from said engaging member to be fitted in corresponding one of said at least two recessed portions, said claw portion being formed on said projecting portion.

5. The laser beam emitting unit according to claim 2, wherein said base plate has a substantially rectangular shape, said at least two receiving portions comprising at least one pair of receiving portions respectively formed on opposite sides of said base plate to be opposed to each other.

6. The laser beam emitting unit according to claim 4, wherein said projecting portion has a substantially U-shape, and comprises a projecting base, said claw portion, and a recessed portion formed between said projecting base and said claw portion, and wherein said lens holder is fixed to said base plate by bending said claw portion along a surface of said base plate so that said engaging member and said projecting base hold a portion of said base plate therebetween.

7. The laser beam emitting unit according to claim 6, wherein the following condition is satisfied:

$$Ze<Z_5<Zt$$

wherein "$Z_5$" represents a thickness of said base plate;

"Zt" represents a distance from a plane including said contacting surface to a first point on a surface of said claw portion in the vicinity of a tip of said claw portion, in said direction substantially perpendicular to said flat portion; and "Ze" represents a distance from said plane to a second point on a surface of said claw portion in the vicinity of the root of said claw portion, in said direction substantially perpendicular to said flat portion.

8. The laser beam emitting unit according to claim 7, wherein said holder support plate is made of a metal.

9. The laser beam emitting unit according to claim 6, wherein said projecting base is fitted in corresponding one of said at least two recessed portions with a minimum clearance.

10. The laser beam emitting unit according to claim 6, wherein said claw portion comprises an inclined engaging surface provided on said claw portion opposing the projecting base, said lens holder being fixed to said base plate with said engaging surface in contact with said surface of said base plate.

11. The laser beam emitting unit according to claim 1, wherein said lens holder is fixed to said holder support plate via at least two set screws, a through hole being formed on said base plate so that a screw driver is accessible to one of said at least two set screws through said through hole.

12. A laser beam emitting unit comprising:

a laser diode;

a collimating lens upon which a laser beam emitted by said laser diode is incident;

a base plate to which said laser diode is fixed; and a holder support plate which is fixed to said base plate and supports said collimating lens;

wherein said base plate includes at least two recessed portions which define a fixing position of said holder support plate relative to said base plate;

wherein said holder support plate comprises a flat portion which faces a front surface of said base plate with a gap between said flat portion and said base plate, and at least two leg portions which extend from said flat portion to said base plate in a direction substantially perpendicular to said flat portion to be associated with said at least two recessed portions; and wherein each of said at least two leg portions comprises:

an engaging member which is in contact with said front surface of said base plate; and a projecting portion which extends from said engaging member to be fitted in corresponding one of said at least two recessed portions, a claw portion being formed on said projecting portion, said claw portion being deformed to be fixed to a rear surface of said base plate with said gap being maintained between said flat portion and said base plate.

13. A laser beam emitting unit comprising:

a base plate to which a laser diode is fixed;

a lens holder which holds a collimating lens through which a laser beam emitted by said laser diode is collimated; and a holder support plate positioned between said base plate and said lens holder to fix said lens holder to said base plate via said holder support plate;

wherein said holder support plate includes a flat portion which faces said base plate with a gap between said flat portion and said base plate, and a pair of leg portions which extend from said flat portion in a direction substantially perpendicular to said flat portion to be engaged with said base plate; and wherein each of said pair of two leg portions includes a claw portion which is deformed to be fixed to said base plate.

* * * * *